US012631331B2

(12) United States Patent
Munsterhuis et al.

(10) Patent No.: US 12,631,331 B2
(45) Date of Patent: May 19, 2026

(54) METHOD AND CONTROLLER FOR OPERATING A GAS BURNER APPLIANCE

(71) Applicant: Pittway Sarl, Rolle (CH)

(72) Inventors: Wim Munsterhuis, Dalen (NL); Gerrit Jan Baarda, Emmen (NL); Andreas Kammerahl, Lemfoerde (DE); Martin Petersmann, Osnabrueck (DE); Anton Quatmann, Vechta (DE); Ulrich Oldehus, Lohne (DE); Clemens Metker, Bad Iburg (DE)

(73) Assignee: Pittway Sarl, Rolle (CH)

( * ) Notice: Subject to any disclaimer, the term of this patent is extended or adjusted under 35 U.S.C. 154(b) by 339 days.

(21) Appl. No.: 18/262,501

(22) PCT Filed: Jan. 21, 2022

(86) PCT No.: PCT/EP2022/051361
§ 371 (c)(1),
(2) Date: Jul. 21, 2023

(87) PCT Pub. No.: WO2022/157320
PCT Pub. Date: Jul. 28, 2022

(65) Prior Publication Data

US 2024/0093868 A1 Mar. 21, 2024

(30) Foreign Application Priority Data

Jan. 25, 2021 (EP) ..... 21153258

(51) Int. Cl.
*F23N 1/02* (2006.01)
*F23D 14/60* (2006.01)
(Continued)

(52) U.S. Cl.
CPC ..... *F23N 1/022* (2013.01); *F23D 14/60* (2013.01); *F23N 1/025* (2013.01); *F23N 5/126* (2013.01);
(Continued)

(58) Field of Classification Search
CPC ..... F23N 1/022; F23N 1/025; F23N 5/126; F23N 5/184; F23D 14/60
(Continued)

(56) References Cited

U.S. PATENT DOCUMENTS 5,358,005 A 10/1994 van Prooijen et al.
6,893,152 B2 5/2005 Cordier et al.
(Continued)

FOREIGN PATENT DOCUMENTS

CA 2378308 A1 11/2001
CN 209558374 U 10/2019
(Continued)

OTHER PUBLICATIONS

International Search Report in PCT International Application No. PCT/EP2022/051361 mailed Mar. 7, 2022.

*Primary Examiner* — Vivek K Shirsat
(74) *Attorney, Agent, or Firm* — Greenberg Traurig LLP; Ryan D. Sharp; David J. Dykeman

(57) ABSTRACT

Method for operating a gas burner appliance (10) comprising: a combustion chamber (11), an ignition device (27), a fan (14), a gas safety valve unit (19) assigned to the gas duct (16), an electric gas flow modulator (18) assigned to the gas duct (16), a sensor (21) positioned between the gas safety valve unit (19) and the gas flow modulator (18), wherein the gas burner appliance (10) is operated to determine the gas family of the gas of the gas/air mixture by the following steps: Before the gas burner appliance becomes started measuring the ambient air pressure by the sensor (21),
(Continued)

wherein the ambient air pressure is measured when the safety valve unit (19) is closed, the gas flow modulator (18) is opened and the fan (14) is stopped. When the gas burner appliance (10) becomes started running the fan (14) at a defined fan speed, increasing the opening of the gas flow modulator (18) while activating the ignition device (27) trying to ignite the gas/air mixture until the activation of ignition device results into a combustion of the gas/air mixture. Determining from the fan speed of the fan (14) and from the measured ambient air pressure an air volume flow. Measuring the gas pressure by the sensor (21) when the safety valve unit (19) is opened, the gas flow modulator (18) is opened and the fan (14) is running. Determining from the opening of the gas flow modulator (18) at which the combustion started and from the measured gas pressure a gas volume flow. Determining a ratio between the gas volume flow and the air volume and from said ratio the gas family of the combusted gas.

14 Claims, 2 Drawing Sheets

(51) Int. Cl.
*F23N 5/12* (2006.01)
*F23N 5/18* (2006.01)

(52) U.S. Cl.
CPC ..... *F23N 5/184* (2013.01); *F23N 2005/181* (2013.01); *F23N 2005/185* (2013.01); *F23N 2221/10* (2020.01); *F23N 2225/06* (2020.01); *F23N 2227/02* (2020.01); *F23N 2227/20* (2020.01); *F23N 2233/08* (2020.01); *F23N 2235/16* (2020.01)

(58) Field of Classification Search
USPC ..... 431/12
See application file for complete search history.

(56) References Cited

U.S. PATENT DOCUMENTS

| | | | | |
|---|---|---|---|---|
| 6,945,507 | B2 | 9/2005 | Baarda et al. | |
| 7,066,203 | B2 | 6/2006 | Baarda | |
| 10,247,416 | B2 | 4/2019 | Munsterhuis et al. | |
| 10,817,002 | B2 | 10/2020 | Baarda et al. | |
| 10,948,090 | B2 | 3/2021 | Baarda | |
| 11,255,542 | B2 | 2/2022 | Metker et al. | |
| 11,635,206 | B2 | 4/2023 | Munsterhuis et al. | |
| 11,708,972 | B2 | 7/2023 | Munsterhuis et al. | |
| 11,773,987 | B2 | 10/2023 | Metker et al. | |
| 2003/0013057 | A1* | 1/2003 | Vegter | F23N 1/002 431/90 |
| 2004/0056221 | A1 | 3/2004 | Baarda et al. | |
| 2004/0062290 | A1 | 4/2004 | Cordier et al. | |
| 2004/0238053 | A1 | 12/2004 | Baarda et al. | |
| 2007/0243496 | A1 | 10/2007 | Thiewes et al. | |
| 2012/0058439 | A1* | 3/2012 | Munsterhuis | F23N 5/003 431/12 |
| 2016/0281984 | A1* | 9/2016 | Munsterhuis | F23N 1/022 |
| 2018/0107231 | A1 | 4/2018 | Svejnoha et al. | |
| 2018/0259179 | A1 | 9/2018 | Kowald et al. | |
| 2021/0364165 | A1* | 11/2021 | Munsterhuis | F23N 5/123 |
| 2024/0093868 | A1* | 3/2024 | Munsterhuis | F23N 1/025 |
| 2024/0200566 | A1 | 6/2024 | Jarysek et al. | |
| 2024/0204610 | A1 | 6/2024 | Wascher et al. | |
| 2024/0230084 | A1* | 7/2024 | Munsterhuis | F23N 1/022 |
| 2024/0247725 | A1* | 7/2024 | Metker | F23N 1/005 |
| 2024/0328621 | A1* | 10/2024 | Munsterhuis | F23N 1/025 |
| 2024/0337385 | A1 | 10/2024 | Metker et al. | |

FOREIGN PATENT DOCUMENTS

| | | | |
|---|---|---|---|
| CN | 116802434 | A | 9/2023 |
| DE | 4337778 | C1 | 1/1995 |
| DE | 19627038 | C2 | 6/1998 |
| DE | 198 24 521 | A1 | 12/1999 |
| DE | 19844856 | C1 | 5/2000 |
| DE | 101 14 901 | A1 | 10/2002 |
| DE | 10 2006 051883 | A1 | 5/2008 |
| DE | 102010004826 | A1 | 7/2011 |
| DE | 102013003524 | B4 | 7/2022 |
| EP | 0640820 | A1 | 8/1994 |
| EP | 0624835 | A1 | 11/1994 |
| EP | 0797032 | A2 | 3/1997 |
| EP | 0601507 | B1 | 4/1997 |
| EP | 0907051 | A1 | 4/1999 |
| EP | 1150070 | A2 | 10/2001 |
| EP | 1160638 | A1 | 12/2001 |
| EP | 2194301 | A1 | 6/2010 |
| EP | 1 370 806 | B1 | 8/2010 |
| EP | 2209057 | B1 | 7/2011 |
| EP | 2 667 097 | A1 | 11/2013 |
| EP | 2966354 | A1 | 1/2016 |
| EP | 3531017 | A1 | 8/2019 |
| EP | 3415817 | B1 | 9/2020 |
| EP | 4033148 | A1 | 7/2022 |
| EP | 3748229 | B1 | 5/2024 |
| EP | 4375573 | A1 | 5/2024 |
| WO | 2008058640 | A1 | 5/2008 |
| WO | 20220157320 | A1 | 7/2022 |

* cited by examiner

METHOD AND CONTROLLER FOR OPERATING A GAS BURNER APPLIANCE

RELATED APPLICATION(S)

This patent application is a U.S. national phase patent application of PCT International Patent Application No. PCT/EP/2022/051361, filed on Jan. 21, 2022, which claims the benefit of and priority to European Patent Application No. EP 21153258.5, filed on Jan. 25, 2021, each of which are hereby incorporated by reference in their entireties.

The invention relates to a method for operating a gas burner appliance. Further on, the invention relates to a controller for operating a gas burner appliance.

EP 2 667 097 A1 discloses a method for operating a gas burner appliance. During burner-on-phases of the gas burner appliance, a gas/air mixture having a defined mixing ratio of gas and air is provided to a burner for combusting the gas/air mixture. The mixing ratio of gas and air of the gas/air mixture corresponds to the so-called λ-value of the gas/air mixture. The gas/air mixture is provided by a mixing device mixing an air flow provided by an air duct with a gas flow provided by a gas duct. The mixing device may be provided by a Venturi nozzle. The air flow flowing through the air duct is provided by a fan in such a way that the fan speed of the fan depends on a nominal burner-load of the gas burner appliance, wherein a fan speed range of the fan defines a so-called modulation range of the gas burner appliance. According to EP 2 667 097 A1, the defined mixing ratio of gas and air and thereby the λ-value of the gas/air mixture is kept constant over the entire modulation range of the gas burner appliance by a pneumatic gas regulation valve. The pneumatic gas regulation valve is provided by a gas armature. In addition to the pneumatic gas regulation valve the gas armature comprises a safety gas valve and a throttle used for calibration. The pneumatic gas regulation valve uses a pressure difference between the gas pressure of the gas flow in the gas duct and a reference pressure, wherein either the air pressure of the air flow in the air duct or the ambient pressure is used as reference pressure, and wherein the pressure difference between the gas pressure of the gas flow in the gas duct and the reference pressure is determined and controlled pneumatically. EP 2 667 097 A1 discloses a method for operating a gas burner appliance in which the defined mixing ratio of the gas/air mixture is kept constant over the entire modulation range of the gas burner. This is done by the pneumatic gas regulation valve establishing a pneumatic control to keep the mixing ratio of gas and air within the gas/air mixture constant.

Instead of using pneumatic gas regulation valve, it is also known from prior art to control the mixing ratio of gas and air within the gas/air mixture by an electric gas flow modulator. The invention relates to a gas burner control making use of such an electric gas flow modulator.

DE 198 24 521 A1 discloses a method to control the mixing ratio of gas and air of the gas/air mixture and thereby the A-value of the gas/air mixture on basis of a signal provided by an electrical or electronic sensor like an anemometer. An actual value corresponding to a pressure ratio between a gas pressure in a gas duct and an air pressure in an air duct or corresponding to a pressure ratio between the gas pressure in the gas duct and the air pressure at the reference point is provided by the electrical or electronic sensor, wherein this actual value is compared with a nominal value. A control variable for the electric gas flow modulator is generated on basis of the control deviation between the actual value and nominal value, wherein the electric gas flow modulator is adjusted on basis of this control variable to control the defined mixing ratio of gas and air in the gas/air mixture thereby keeping the λ-value of the gas/air mixture constant.

As mentioned above, the amount of the air flow and thereby the amount of the flow of the gas/air mixture having the defined mixing ratio of gas and air provided to the burner chamber depends on the desired burner load. The nominal burner-load corresponds to a desired heat demand. The nominal burner-load defines the fan speed at which the fan is operated. The fan speed range of the fan of the gas burner appliance defines the modulation range of the gas burner appliance. A maximum fan speed of the fan defines the maximum burner-load of the gas burner appliance.

If a desired heat demand requires maximum burner load, then the fan is operated at maximum fan speed. If a desired heat demand requires burner-load being 50% of the maximum burner load, then the fan is operated at 50% of the maximum fan speed. If a desired heat demand requires burner-load being 20% of the maximum burner load, then the fan is operated at 20% of the maximum fan speed. As mentioned above, at any burner load of the gas burner appliance and at any fan sped of the fan the mixing ratio of gas and air of the is kept constant.

The gas burner appliance may be operated with different gases belonging to different gas families. The gas may belong to the so-called liquefied gas family or to the so-called natural gas family or to the so-called town gas family. These gas families differ from each other by the so-called Wobbe Index being representative of the calorific value of the gas. In order to ensure a proper combustion of the gas/air mixture in a gas burner appliance, it is of importance that the gas family of the gas to be combusted is known. When knowing the gas family of the gas to be combusted, the operation of gas burner appliance can be adapted to the gas family.

For the time being the operation of a gas burner appliance taking into account the gas family of gas to be combusted requires the use of mass flow sensors. This results into high costs.

DE 101 14 901 A1, EP 1 370 806 B1 and U.S. Pat. No. 6,893,152 B2 all disclose methods for operating a gas burner appliance making us of mass flow sensors.

There is a desire to operate a gas burner appliance taking into account the gas family of the combusted gas and to determine the gas family of the combusted gas not requiring a mass flow sensor.

Against this background, a novel method for operating a gas burner appliance is provided.

With the method according to the present invention the gas burner appliance is operated to determine the gas family of the gas of the gas/air mixture by the following steps:

Before the gas burner appliance becomes started, measuring the ambient air pressure by a sensor positioned between the gas safety valve unit and the gas flow modulator. Said ambient air pressure is measured when the safety valve unit is closed, the gas flow modulator is opened and the fan is stopped.

When the gas burner appliance becomes started, running the fan at a defined fan speed, increasing the opening of the gas flow modulator or decreasing the flow resistance of the gas flow modulator while activating an ignition device trying to ignite the gas/air mixture until the activation of ignition device results into a combustion of the gas/air mixture monitored by a combustion monitoring device.

Determining from the fan speed of the fan and from the measured ambient air pressure an air volume flow or an air mass flow.

Measuring the gas pressure by the sensor positioned between the gas safety valve unit and the gas flow modulator. Said gas pressure is measured when the safety valve unit is opened, the gas flow modulator is opened and the fan is running.

Determining from the opening of the gas flow modulator or from the flow resistance of the gas flow modulator at which the combustion started upon activation of the ignition device and from the measured gas pressure a gas volume flow or a gas mass flow.

Determining a ratio between the gas volume flow and the air volume flow or a ratio between the gas mass flow and the air mass flow.

Determining from the respective ratio the gas family of the combusted gas, namely if the combusted gas belongs to the liquefied gas family or the natural gas family or the town gas family.

The method according to the present invention allows to determine the gas family of the gas to be combusted not requiring a mass flow sensor.

On basis of the determined gas family a proper combustion of the gas/air mixture in a gas burner appliance can be ensured.

The method may further comprise the following steps: Measuring the ambient air temperature. Determining on basis of the air volume flow and the ambient air temperature the air mass flow. Measuring the gas temperature. Determining on basis of the gas volume flow and the gas temperature the gas mass flow. This allows a further improved determination of the gas family of the gas to be combusted not requiring a mass flow sensor.

The method may further comprise the following step: Determining on basis of the gas family of the combusted gas an operating parameter set to control combustion of the gas/air mixture within the combustion chamber of the gas burner appliance. A proper combustion of the gas/air mixture in a gas burner appliance can be ensured on basis of such an operating parameter set.

The method may further comprise the following steps: Determining on a preliminary basis the preliminary gas family of the gas to be combusted, namely on basis of the gas pressure which is measured when the safety valve unit is opened, when the gas flow modulator is opened and when the fan is running. Determining on basis of the preliminary gas family of the gas to be combusted a preliminary parameter set to start the gas burner appliance. With these method steps the start of the gas burner appliance can be improved.

The method may further comprise the following steps: Operating the gas burner appliance on basis of the operating parameter set to control the mixing ratio of gas and air or the λ-value of the gas/air mixture at a constant value. Determining the opening of the gas flow modulator or the flow resistance of the gas flow modulator to keep the mixing ratio of gas and air or a λ-value of the gas/air mixture at the constant value. Verifying the previously detected gas family of the combusted gas on basis of said opening of the gas flow modulator or said flow resistance of the gas flow modulator. With these method steps the operation of the gas burner appliance can be further improved ensuring a proper combustion of the gas/air mixture in a gas burner appliance.

The controller for operating a gas burner appliance according to the present invention is defined in claim 12.

Preferred developments of the invention are provided by the dependent claims and the description which follows.

Exemplary embodiments are explained in more detail on the basis of the drawing, in which.

The present invention relates to a method and a controller for operating a gas burner appliance. The invention allows to determine the gas family of gas of a gas/air mixture combusted with the gas burner appliance. Further, the invention allows to operate the gas burner appliance on basis of the determined gas family to ensure a proper combustion.

Figure 1:
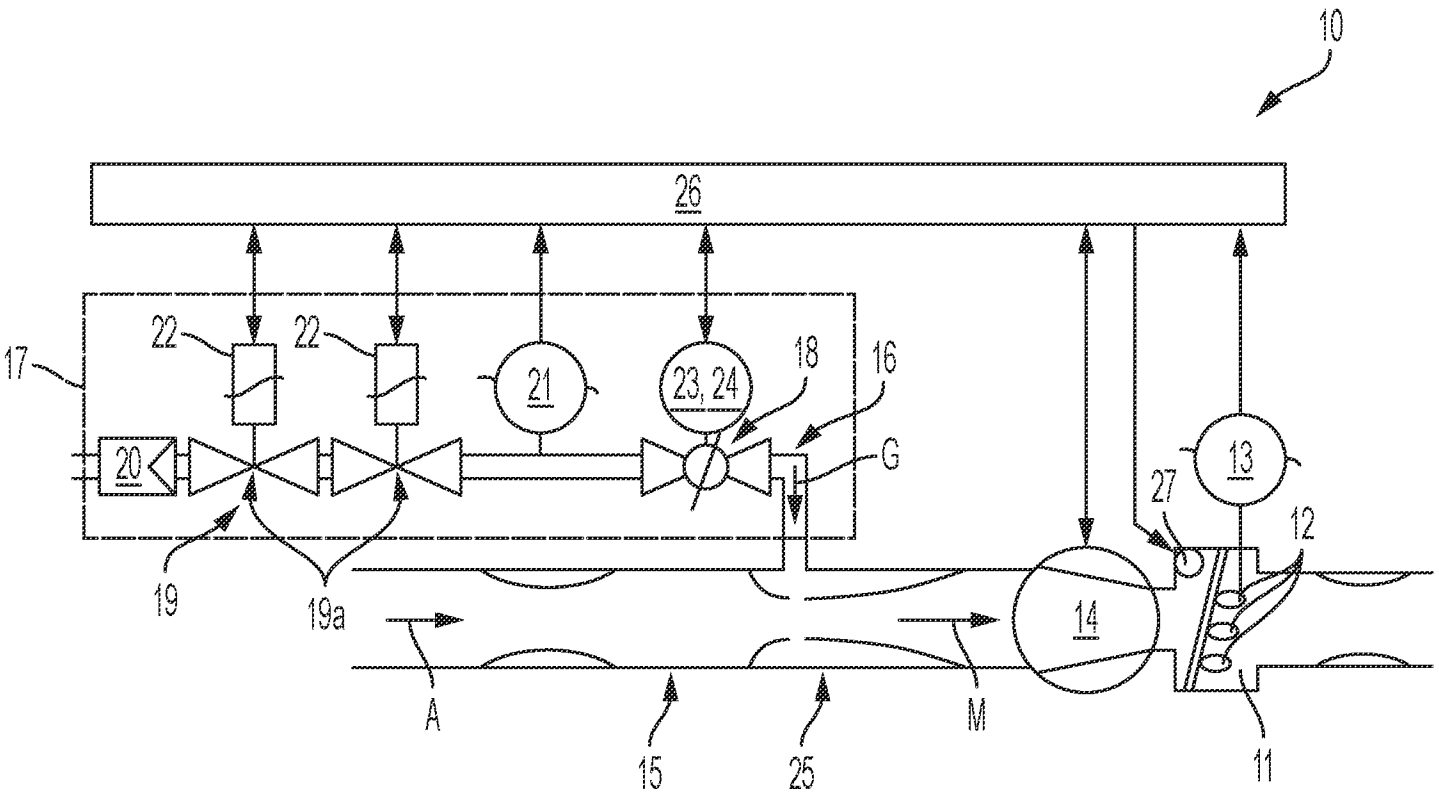
FIG. 1 shows a first gas burner appliance to be operated by the method and controller of the present invention.

FIG. 1 shows a schematic view of a first exemplary gas burner appliance 10. The gas burner appliance 10 comprises a gas burner chamber 11 in which combustion of a gas/air mixture M having a defined mixing ratio of gas G and air A takes place during burner-on phases of the gas burner appliance 10. The mixing ratio of gas G and air A of the gas/air mixture M corresponds to the so-called λ-value of the gas/air mixture M.

An ignition device 27 is used to ignite the gas/air mixture M for the combustion of the gas/air mixture M within the combustion chamber 11. The ignition device 27 of the gas burner appliance 10 is preferably positioned within the combustion chamber 11. The ignition device 27 can be activated by a controller 26 of the gas burner appliance 10.

The combustion of the gas/air mixture results into flames 12. The combustion of the gas/air mixture resulting into the flames 12 is monitored by a combustion monitoring device 13. In the embodiment of FIG. 1 the combustion monitoring device 13 is provided by a flame ionization sensor. Such a flame ionization sensor provides as output signal an electrical flame ionization current.

The combustion monitoring device 13 provides its output signal to the controller 26.

The gas/air mixture M is provided to the burner chamber 11 of the gas burner appliance 10 by mixing a flow of the air A with a flow of the gas G. A fan 14 sucks in air A flowing through an air duct 15 and gas G flowing through a gas duct 16. The fan 14 is operated by the controller 26.

A gas flow modulator 18 for adjusting the gas flow through the gas duct 16 and a safety gas valves unit 19 having preferably two safety gas valves 19*a* are assigned to the gas duct 16. The gas flow modulator 18 and the safety gas valves 19*a* are part of a gas armature 17 further comprising a sieve 20 and at least one sensor 21.

In FIG. 1 the sensor 21 is a pressure and temperature sensor measuring both pressure and temperature. It is possible that the gas armature 17 may comprise separate sensors to measure pressure and temperature. It is also possible that the gas armature 17 may comprise only a pressure sensor.

The at least one sensor 21 provides its output signal to the controller 26.

The gas safety valves 19*a* are operated by electric coils 22 being part of the gas armature 17. In burner-on phases the electric coils 22 are energized by the controller 26 to open the gas safety valves 19*a*. In burner-off phases the gas safety valves 19*a* are closed. In FIG. 1, each gas safety valve 19*a* is operated by one separate electric coil 22. It is possible to operate the gas safety valves 19*a* by a common electric coil 22.

The gas flow modulator 18 is operated by a motor 23 also having an electric coil 24. The gas flow modulator 18 is an electric gas flow modulator 18 operated by the controller 26.

The gas/air mixture M having the defined mixing ratio of gas G and air A is provided to the burner chamber 11 of the gas burner appliance 10. The gas/air mixture M is provided by mixing the air flow A provided by an air duct 15 with a gas flow G provided by a gas duct 16. The air flow and the gas flow become mixed by a mixing device 25. The mixing device 25 may be a venturi nozzle.

The quantity of the air flow A and thereby the quantity of the gas/air mixture flow M is adjusted by the fan 14, namely by the speed of the fan 14. The fan speed can be adjusted on basis of a nominal burner-load. The fan 14 is operated by the controller 26. The fan speed range of the fan 14 defines a modulation range of the gas burner appliance 10. A modulation of "1" means that the fan 14 is operated at maximum fan speed (100% of maximum fan speed) and thereby at a full-load of the gas burner appliance 10. A modulation of "2" means that the fan 14 is operated at 50% of the maximum fan speed and a modulation of "5" means that the fan 14 is operated at 20% of the maximum fan speed. By changing the fan speed of the fan 14, the burner-load of the gas burner appliance 10 can be adjusted.

Over the entire modulation range of the gas burner appliance 10 the defined mixing ratio of gas G and air A within the gas/air mixture M and thereby the λ-value of the gas/air mixture M is kept constant. Said defined mixing ratio of gas G and air A or said λ-value of the gas/air mixture M is controlled over the modulation range of the gas burner appliance using the electric gas flow modulator 18 of a gas armature 17 in order to keep the defined mixing ratio of gas and air and thereby the λ-value constant over the modulation range of the gas burner appliance 10. In FIG. 1, the control variable for the electric gas flow modulator 18 in order to keep the λ-value constant is generated by the controller 26 on basis of the flame ionization current provided by the flame ionization sensor 13.

Figure 2:
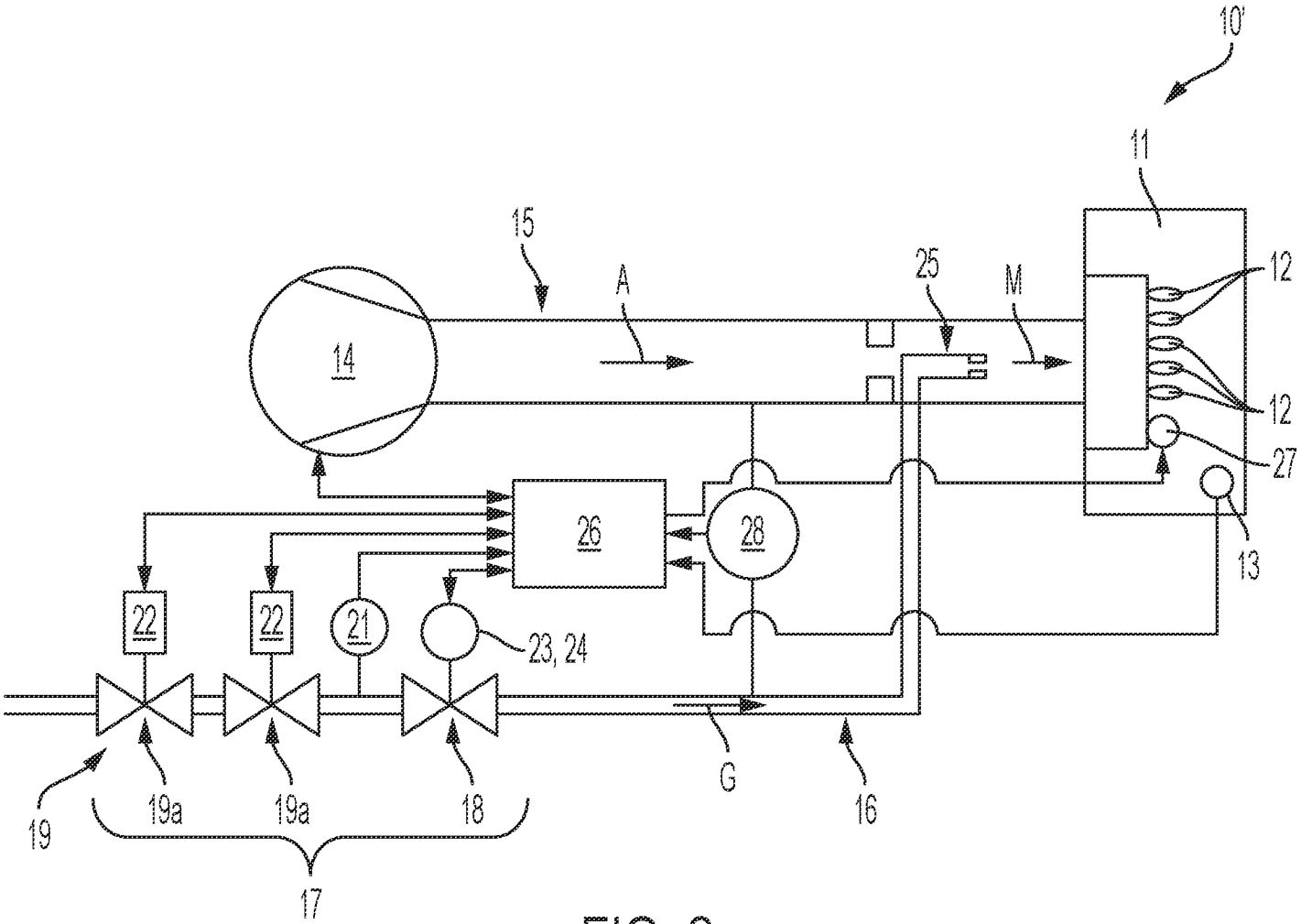
FIG. 2 shows a second gas burner appliance to be operated by the method and controller of the present invention.

FIG. 2 shows a schematic view of another exemplary gas burner appliance 10'.

In FIGS. 1 and 2 identical reference numbers are used for identical parts. In order to avoid unnecessary repetitions, only the differences of the gas burner appliances 10, 10' are described below with reference to FIG. 2.

In FIG. 2, the constant mixing ratio of gas G and air A within the gas/air mixture M is controlled by the electric gas flow modulator 18 on basis of a signal provided by an electric or electronic pressure sensor 28 and not on basis of the flame ionization current provided by the flame ionization sensor 13.

In FIG. 2, the electric or electronic sensor 28 may provide to the controller 26 an actual value corresponding to a pressure ratio between a gas pressure in a gas duct 16 and an air pressure in an air duct 15 or corresponding to a pressure ratio between the gas pressure in the gas duct 16 and the air pressure at the reference point. The controller 26 may compare said actual value with a nominal value. In this case, the controller 26 may generate the control variable for the electric gas flow modulator 18 on basis of the control deviation between the actual value and the nominal value, wherein the gas flow modulator 18 may be operated on basis of this control variable to keep over the entire modulation range of the gas burner appliance 10 the defined mixing ratio of gas and air and thereby the λ-value constant.

In FIG. 2, the combustion monitoring device 13 may be provided by a photo diode monitoring the presence of the flames 12.

According to the present invention, the method for operating a gas burner appliance, preferably the gas burner appliances 10, 10' of FIGS. 1 and 2, allows to determine the gas family of the gas of the gas/air mixture. The method comprises the following steps:

Before the gas burner appliance 10, 10' becomes started, measuring the ambient air pressure by the pressure and temperature sensor 21.

Said ambient air pressure is measured when the safety gas valve unit 19 having the at least one gas safety valve **19*a* is closed, when the gas flow modulator 18 is opened and when the fan 14 is stopped. The pressure and temperature sensor 21 may also measure the ambient air temperature when the safety gas valve unit 19 is closed, when the gas flow modulator 18 is opened and when the fan 14** is stopped.

When the gas burner appliance 10, 10' becomes started, running the fan 14 at a defined fan speed, increasing the opening of the gas flow modulator 18 or decreasing the flow resistance of the gas flow modulator 18 while activating the ignition device 27 trying to ignite the gas/air mixture M until the activation of ignition device 27 results into a combustion of the gas/air mixture. The combustion of the gas/air mixture is monitored by the combustion monitoring device 13.

Determining from the fan speed of the fan 14 and from the measured ambient air pressure an air volume flow or an air mass flow.

Measuring the gas pressure by the pressure and temperature sensor 21. Said gas pressure is measured with safety gas valve unit 19 having both safety valves **19*a* opened, when the gas flow modulator 18 is opened and when the fan 14** is running.

The pressure and temperature sensor 21 may also measure the gas temperature.

Determining from the opening of the gas flow modulator 18 or the flow resistance of the gas flow modulator 18 at which the combustion started upon activation of the ignition device and from the measured gas pressure a gas volume flow or a gas mass flow.

Determining a ratio between the gas volume flow and the air volume flow or a ratio between the gas mass flow and the air mass flow.

When the pressure and temperature sensor 21 measured the ambient air temperature and the gas temperature, it is possible to determine on basis of the gas volume flow and on basis of the gas temperature the gas mass flow as well as on basis of the air volume flow and on basis of the ambient air temperature the air mass flow. This may be done on basis of a characteristic curve or a characteristic map or a characteristic table implemented within the controller 26.

Determining from the respective ratio between the gas volume flow and the air volume flow or from the respective ratio between the gas mass flow and the air mass flow the gas family of the combusted gas, namely if the combusted gas belongs to the liquefied gas family or the natural gas family or the town gas family. This can also be done on basis of a characteristic curve or a characteristic map or a characteristic table implemented within the controller 26.

The method according to the invention determines the gas family of the combusted gas. On basis of the determined gas family a proper combustion of the gas/air mixture in a gas burner appliance 10, 10' can be ensured.

Preferably, the method comprises the steps: Determining on a preliminary basis from the gas pressure which is measured by the sensor 21 when the safety valve unit 19 is opened, when the gas flow modulator 18 is opened and when the fan 14 is running, a preliminary gas family of the gas to be combusted. Determining on basis of the preliminary gas family of the gas to be combusted a preliminary parameter set to start the gas burner appliance 10, 10'. Such a preliminary parameter set may be implemented within the controller 26. With these method steps the start of the gas burner appliance 10, 10' can be improved.

Preferably, the method comprises the steps: Determining on basis of the gas family of the combusted gas an operating parameter set to control combustion of the gas/air mixture within the combustion chamber 11 of the gas burner appliance 10, 10'. Such an operating parameter set may be implemented within the controller 26. A proper combustion of the gas/air mixture in a gas burner appliance 10, 10' can be ensured on basis of such operating parameter set.

After the gas family of the combusted gas has been determined and after the operating parameter set to control combustion of the gas/air mixture within the combustion chamber 11 of the gas burner appliance 10, 10' has been determined on basis of the gas family, the gas burner appliance 10, 10' may be operated at a defined burner load. This defined burner load is preferably at least 50% of the maximum burner load, most preferably at least 75% of the maximum burner load or is at maximum burner load. At this defined burner load the mixing ratio of gas and air or the λ-value of the gas/air mixture is controlled at a constant value using the operating parameter set. The opening of the gas flow modulator 18 or the flow resistance of the gas flow modulator 18 to keep the mixing ratio of gas and air or a λ-value of the gas/air mixture at the constant value is determined. The gas family of the combusted gas is verified on basis of said opening of the gas flow modulator 18 or said flow resistance of the gas flow modulator 18. It is for example possible to check if said opening of the gas flow modulator 18 or said flow resistance of the gas flow modulator 18 together with the ambient air pressure and the gas pressure matches with corresponding values for the respective gas family. If this is the case, the determined gas family is found to be correct with the verification. If this is not the case, the determined gas family is found to be incorrect with the verification. If the gas family is found to be incorrect, the method to determine the gas family is repeated.

As mentioned above, the mixing ratio of gas and air or said λ-value is controlled over the modulation range of the gas burner appliance 10, 10' using the electric gas flow modulator 18 of the gas burner appliance 10, 10'.

In FIG. 1, the electric gas flow modulator 18 controls said defined mixing ratio of gas and air or said λ-value of the gas/air mixture in such a way that a flame ionization current is measured by the combustion monitoring device 13, and that a control variable for the electric gas flow modulator 18 is generated on basis of the flame ionization current. In FIG. 2, the pressure difference between the gas pressure and the air pressure is measured by an electric or electronic sensor 28 of the gas burner appliance 10', and a control variable for the electric gas flow modulator 18 is generated on basis of the output signal provided by the electric or electronic sensor 28.

The electric gas flow modulator 18 of the gas armature 17 is operated by energizing the electric coil 24 of the gas armature 17. The at least one safety gas valve 19*a* of the gas armature 17 is operated by energizing the at least one electric coil 22 of the gas armature 17.

The method may comprise the following steps: Determining at least one electric coil resistance of at least one of the electric coils 22, 24. Determining at least one temperature offset as a function of the at least one electric coil resistance and as a function of at least one time interval for which the respective electric coil 22, 24 becomes energized. Compensating the measured ambient air temperature and/or compensating the measured gas temperature by the at least one temperature offset thereby providing a compensated ambient air temperature and/or a compensated gas temperature. Determining the air mass flow on basis of the ambient air pressure and on basis of the compensated ambient air temperature and/or determining the gas mass flow on basis of the gas pressure and/or on basis of the compensated gas temperature.

Preferably, the electric coil resistance of the respective electric coil 22, 24 is calculated on basis of the electrical current and on basis of the electrical voltage both measured at or across the respective electric coil 22, 24.

The invention further provides a controller 26 for operating the gas burner appliance 10, 10'. The controller 26 is configured to operate the gas burner appliance 10, 10' according to the above described method.

The controller 26 is configured to determine on basis of a heat demand a nominal burner-load to provide the heat demand, wherein the nominal burner-load is a load within a modulation range of the gas burner appliance 10, 10'.

The controller 26 is further configured determine on basis of the nominal burner-load the fan speed of the fan 14 of the gas burner appliance 10, 10' which is needed to provide the burner load, wherein a fan speed range of the fan 14 defines the modulation range of the gas burner appliance 10, 10'.

The controller 26 is further configured to receive from the sensor 21 the measured ambient air pressure and preferably the measured ambient air temperature, wherein the ambient air pressure and preferably the ambient air temperature is measured when the safety valve unit 19 is closed, when the gas flow modulator 18 is opened and when the fan 14 is stopped, namely before the gas burner appliance 10, 10' becomes started.

The controller 26 is further configured to receive from the sensor 21 the measured gas pressure and preferably the measured gas temperature, wherein the gas pressure and preferably the measured gas temperature is measured when the safety valve unit 19 is opened, when the gas flow modulator 18 is opened and when the fan 14 is running.

The controller 26 is further configured to run the fan 14 at a defined fan speed and to increase the opening of the gas flow modulator 18 or to decrease the flow resistance of the gas flow modulator 18 while also activating the ignition device 27, namely when the gas burner appliance 10, 10' becomes started.

The controller 26 is further configured to receive from the combustion monitoring device 13 a signal indicating that the activation of ignition device 27 results into a combustion of the gas/air mixture. When the activation of ignition device 27 results into a combustion of the gas/air mixture, the controller 26 is further configured to determine the respective opening of the gas flow modulator 18 or the respective flow resistance of the gas flow modulator 18.

The controller 26 is further configured to determine from the fan speed of the fan 14 and from the measured ambient air pressure an air volume flow or an air mass flow.

The controller 26 is further configured to determine from the opening of the gas flow modulator 18 or from the flow resistance of the gas flow modulator 18 at which the combustion started upon activation of the ignition device 27 and from the measured gas pressure a gas volume flow or a gas mass flow.

The controller 26 is further configured to determine a ratio between the gas volume flow and the air volume flow or a ratio between the gas mass flow and the air mass flow, and to determine from the respective ratio the gas family of the combusted gas, namely if the combusted gas belongs to the liquefied gas family or the natural gas family or the town gas family.

The controller 26 is further configured to adjust the setting of the gas burner appliance on basis of the determined gas family. This setting preferably describes in FIG. 1 the relation between ionization current and λ-value.

LIST OF REFERENCE SIGNS

10 gas burner appliance
10' gas burner appliance
11 burner chamber
12 flame
13 combustion monitoring device
14 fan
15 air duct
16 gas duct
17 gas armature
18 gas flow modulator
19 safety gas valve unit
19*a* safety gas valve
20 sieve
21 sensor
22 coil
23 motor
24 coil
25 mixer
26 controller
27 ignition device
28 electric or electronic sensor

The invention claimed is:

1. A method for operating a gas burner appliance, the gas burner appliance comprising:

a combustion chamber in which a gas/air mixture having a defined mixing ratio of gas and air or a defined λ-value is combusted, an ignition device to ignite the gas/air mixture for the combustion of the gas/air mixture within the combustion chamber, a combustion monitoring device to monitor if combustion takes place withing the combustion chamber, a mixing device to provide said gas/air mixture by mixing an air flow provided by an air duct with a gas flow provided by a gas duct, a fan to provide the air flow or the flow of the gas/air mixture, namely in such a way that a fan speed of the fan depends on a nominal burner-load of the gas burner appliance, a gas safety valve unit having at least one gas safety valve assigned to the gas duct to open or close the gas duct, an electric gas flow modulator assigned to the gas duct to keep the defined mixing ratio of gas and air or the defined λ-value of the gas/air mixture constant over the modulation range of the gas burner appliance, a sensor positioned between the gas safety valve unit and the gas flow modulator configured to provide at least a pressure measurement, the method comprising:

before the gas burner appliance becomes started, measuring ambient air pressure by the sensor, wherein the ambient air pressure is measured when the safety valve unit is closed, the gas flow modulator is opened, and the fan is stopped, when the gas burner appliance becomes started:

running the fan at a defined fan speed, increasing the opening of the gas flow modulator or decreasing a flow resistance of the gas flow modulator while activating the ignition device trying to ignite the gas/air mixture until the activation of ignition device results into a combustion of the gas/air mixture monitored by the combustion monitoring device, determining from the fan speed of the fan and from the measured ambient air pressure an air volume flow or an air mass flow, measuring the gas pressure by the sensor when the safety valve unit is opened, the gas flow modulator is opened, and the fan is running, determining from the opening of the gas flow modulator or the flow resistance of the gas flow modulator at which the combustion started upon activation of the ignition device and from the measured gas pressure a gas volume flow or a gas mass flow, determining a ratio between the gas volume flow and the air volume flow or a ratio between the gas mass flow and the air mass flow, and determining from the respective ratio a gas family of the combusted gas, including determining if the combusted gas belongs to a liquefied gas family or a natural gas family or a town gas family.

2. The method of claim 1, comprising:

measuring ambient air temperature, and determining the air mass flow based on the air volume flow and the ambient air temperature.

3. The method of claim 2, wherein the ambient air temperature is measured when the safety valve unit is closed, and the gas flow modulator is opened.

4. The method of claim 1, comprising:

measuring a gas temperature, and determining the gas mass flow based on the gas volume flow and the gas temperature.

5. The method of claim 4, wherein the gas temperature is measured when the safety valve unit is opened, the gas flow modulator is opened, and the fan is running.

6. The method of claim 2, wherein the ambient air temperature is measured by a sensor positioned between the gas safety valve unit and the gas flow modulator, said sensor being integrated into the sensor providing the pressure measurement.

7. The method of claim 1, comprising:

determining a preliminary gas family of the gas to be combusted on a preliminary basis from the gas pressure, which is measured when the safety valve unit is opened, when the gas flow modulator is opened, and when the fan is running; and determining a preliminary parameter set to start the gas burner appliance based on the preliminary gas family of the gas to be combusted.

8. The method of claim 1, comprising:

determining an operating parameter set to control combustion of the gas/air mixture within the combustion chamber of the gas burner appliance based on the gas family of the combusted gas.

9. The method of claim 8, comprising:

operating the gas burner appliance based on the operating parameter set to control the mixing ratio of gas and air or the λ-value of the gas/air mixture at a constant value;

determining the opening of the gas flow modulator or the flow resistance of the gas flow modulator to keep the mixing ratio of gas and air or a λ-value of the gas/air mixture at the constant value, and verifying the gas family of the combusted gas based on said opening of the gas flow modulator or said flow resistance of the gas flow modulator.

10. The method of claim 1, wherein the electric gas flow modulator controls said defined mixing ratio of gas and air or said λ-value of the gas/air mixture in such a way that a flame ionization current is measured by the combustion monitoring device monitoring flames resulting from the combustion of the gas/air mixture within the combustion chamber, and a control variable for the electric gas flow modulator is generated based on the flame ionization current, or a pressure difference between the gas pressure and the air pressure is measured by an electric or electronic sensor of the gas burner appliance, and a control variable for the electric gas flow modulator is generated based on an output signal provided by the electric or electronic sensor.

11. The method of claim 2, comprising:

operating the electric gas flow modulator of a gas armature by energizing an electric coil of the gas armature, operating the at least one safety gas valve of the gas armature by energizing at least one electric coil of the gas armature, determining at least one electric coil resistance of at least one of the electric coils, determining at least one temperature offset as a function of the at least one electric coil resistance and as a function of at least one time interval for which the respective electric coil becomes energized, compensating the measured ambient air temperature and/or compensating the measured gas temperature by the at least one temperature offset thereby providing a compensated ambient air temperature and/or a compensated gas temperature, and determining the air mass flow based on the ambient air pressure and based on the compensated ambient air temperature and/or determining the gas mass flow based on the gas pressure and/or based on the compensated gas temperature.

12. A controller for a gas burner appliance configured to operate the gas burner appliance, the controller being configured to:

determine a nominal burner-load based on a heat demand, wherein the nominal burner-load is a load within a modulation range of the gas burner appliance; and determine a fan speed of a fan of the gas burner appliance which is needed to provide the burner load based on the nominal burner-load, wherein a fan speed range of the fan defines the modulation range of the gas burner appliance, wherein the controller is further configured to operate the gas burner appliance according to the method of claim 1.

13. The method of claim 4, wherein the gas temperature is measured by a sensor positioned between the gas safety valve unit and the gas flow modulator, said sensor being integrated into the sensor providing the pressure measurement.

14. The method of claim 1, wherein the combustion monitoring device is a flame ionization sensor of the gas burner appliance.

* * * * *